US011158158B2

(12) United States Patent
Ando et al.

(10) Patent No.: US 11,158,158 B2
(45) Date of Patent: Oct. 26, 2021

(54) GAME SYSTEM, GAME DEVICE, SERVER, RECORDING MEDIUM AND ITEM PURCHASE LIMITING METHOD

(71) Applicants: Kaori Ando, Kyoto (JP); Yuki Okada, Kyoto (JP); Norio Matsumura, Tokyo (JP); Masayuki Wada, Tokyo (JP)

(72) Inventors: Kaori Ando, Kyoto (JP); Yuki Okada, Kyoto (JP); Norio Matsumura, Tokyo (JP); Masayuki Wada, Tokyo (JP)

(73) Assignees: NINTENDO CO., LTD., Kyoto (JP); CREATURES INC., Tokyo (JP); THE POKÉMON COMPANY, Tokyo (JP)

( * ) Notice: Subject to any disclaimer, the term of this patent is extended or adjusted under 35 U.S.C. 154(b) by 449 days.

(21) Appl. No.: 14/993,542

(22) Filed: Jan. 12, 2016

(65) Prior Publication Data

US 2017/0103606 A1 Apr. 13, 2017

(30) Foreign Application Priority Data

Oct. 8, 2015 (JP) ..... JP2015-200431

(51) Int. Cl.
*G07F 17/32* (2006.01)

(52) U.S. Cl.
CPC ..... *G07F 17/3227* (2013.01); *G07F 17/3241* (2013.01); *G07F 17/3244* (2013.01)

(58) Field of Classification Search
CPC ..... G07F 17/3227; G07F 17/3241; G07F 17/3244
See application file for complete search history.

(56) References Cited

U.S. PATENT DOCUMENTS 8,090,618 B1 * 1/2012 Chu ..... G06Q 30/0209 705/14.12
9,105,155 B1 * 8/2015 Harris ..... G07F 17/3255
(Continued)

FOREIGN PATENT DOCUMENTS

JP 2009213736 A * 9/2009
JP 2013-198589 A 10/2013
(Continued)

OTHER PUBLICATIONS

Hiroaki Setoriyama, Translation of JP2009213736, Patent Translate by EPO, pp. 1-31.*
(Continued)

*Primary Examiner* — Malina D. Blaise
(74) *Attorney, Agent, or Firm* — Nixon & Vanderhye, PC

(57) ABSTRACT

An example system includes a game device including a game processing unit performing information processing concerning a game and a communication unit performing communication via a network, and a communication unit performing communication with the game device via the network. The game device includes a purchase request transmission unit transmitting a purchase request for the first item to be used in the game to the server by communication through the communication unit. The server includes a purchase request reception unit receiving the purchase request transmitted by the purchase request transmission unit, and a first item imparting unit imparting the first item in response to the purchase request received by the purchase request reception unit. An upper limit is set to the cumulative number of the purchased first items for the user who plays the game using the game device.

26 Claims, 14 Drawing Sheets

(56) References Cited

U.S. PATENT DOCUMENTS 9,495,703 B1* 11/2016 Kaye, III ..... G06Q 40/00
9,582,965 B1* 2/2017 Schultz ..... G07F 17/326
9,623,335 B1* 4/2017 Kim ..... G06Q 30/0224
2004/0073488 A1* 4/2004 Etuk ..... G06Q 20/06 434/350
2006/0281535 A1* 12/2006 Bogan ..... A63F 13/10 463/23
2007/0111770 A1* 5/2007 Van Luchene ..... A63F 13/12 463/7
2008/0004116 A1* 1/2008 Van Luchene ..... G07F 17/32 463/42
2008/0046222 A1* 2/2008 Van Luchene ..... G07F 17/32 703/6
2008/0270240 A1* 10/2008 Chu ..... G06Q 10/06375 705/14.11
2009/0325685 A1* 12/2009 Webb ..... A63F 13/12 463/25
2010/0167814 A1* 7/2010 Kim ..... G06Q 20/12 463/25
2010/0173702 A1* 7/2010 Van Luchene ..... G06Q 40/02 463/29
2011/0212762 A1* 9/2011 Ocko ..... G06Q 10/10 463/25
2012/0066334 A1* 3/2012 Morimura ..... H04L 12/1822 709/212
2012/0283024 A1* 11/2012 Van Luchene ..... G07F 17/32 463/42
2013/0054409 A1* 2/2013 Lee ..... G06Q 20/1235 705/26.8
2013/0143644 A1* 6/2013 Van Luchene ..... G06Q 40/02 463/25
2013/0143670 A1* 6/2013 Junkin ..... G06Q 30/0283 463/42
2013/0159138 A1* 6/2013 Nagasaka ..... G06Q 30/0609 705/26.35
2013/0185206 A1* 7/2013 Leggett ..... G06Q 20/32 705/44
2014/0073416 A1* 3/2014 Toyama ..... G07F 17/3251 463/25
2014/0155141 A1* 6/2014 Kashyap ..... G07F 17/3244 463/25
2014/0194197 A1* 7/2014 Graziosi ..... A63F 13/61 463/29
2014/0228097 A1* 8/2014 Kawamoto ..... A63F 13/792 463/25
2014/0278872 A1* 9/2014 Shimizu ..... G06Q 30/0217 705/14.19
2014/0278873 A1* 9/2014 Shimizu ..... G06Q 30/0217 705/14.19
2014/0357381 A1* 12/2014 Jung ..... G06Q 50/10 463/43
2015/0269813 A1* 9/2015 Severance ..... G06Q 40/04 463/9
2017/0100674 A1* 4/2017 Ntoulas ..... A63F 13/825
2017/0113144 A1* 4/2017 McDonald ..... A63F 13/795
2017/0157503 A1* 6/2017 White, Sr. ..... A63F 3/0478

FOREIGN PATENT DOCUMENTS

JP 5712445 B1 3/2015
WO WO 2014/087540 6/2014

OTHER PUBLICATIONS https://www.nintendo.co.jp/3ds/dl/kcfa/, Released Apr. 8, 2015, 2 pages.
http://www.pokemon.co.jp/ex/m-scramble/enjoy/06.html, Released Apr. 8, 2015, 3 pages.
Japanese Office Action dated Apr. 10, 2018 in corresponding Japanese Patent Application No. 2015-200431 (with translation).
La Corda d'Oro 2—Maestro Training Lecture, p. 15, 25, First Edition, Jul. 11, 2007, Koei Co., Ltd.
Animal Crossing: New Leaf—Famitsu DS Plus Wii, p. 7, 2nd issue of vol. 15, Dec. 21, 2012, Enterbrain.
Animal Crossing: Let's to go the City—Collectors File, p. 20, Jan. 1, 2009, Ascii Media Works.
Tales of the Heroes: Twin Brave—Official Complete Guide, p. 166, First edition, Mar. 23, 2012, NAMCO BANDAI Games Inc.
How to make, sell, and develop successful iPhone applications, p. 23, first edition, Jul. 31, 2013, Mynavi Corporation.
Nihon Falcom Corporation's Official—Ys; Foliage Ocean in CELCETA,—The Complete Guide, p. 157, First edition, Sep. 27, 2012, Ascii Media Works.

* cited by examiner

GAME SYSTEM, GAME DEVICE, SERVER, RECORDING MEDIUM AND ITEM PURCHASE LIMITING METHOD

CROSS-REFERENCE TO RELATED APPLICATIONS

This application is based upon and claims the benefit of priority of the prior Japanese Patent Application No. 2015-200431, filed on Oct. 8, 2015, the entire contents of which are incorporated herein by reference.

FIELD

The present technology herein relates to a game system, a game device, a server, a recording medium and an item purchase limiting method that allow a user to purchase an item usable in a game through communication between the game device and the server.

BACKGROUND AND SUMMARY

A game which is implemented by communication between a game device and a server via a network, a so-called network game, has widely been spread. Conventionally, a recording medium in which an application program, data and the like for implementing a game is sold and a user who purchased the recording medium loads it to a game device and reads out an application program, data and the like to implement the game. An application program, data and the like of a game may be downloaded from a server to a game device via a network in some cases. Such a sales method is called, for example, download distribution. In recent years, a charging method is often employed in which a basic application program, data and the like for realizing a game are offered free of charge while an item, a character, an additional scenario or the like that may be used in a game is sold for a fee. Such a charging method is called, for example, item charging.

According to an aspect of the embodiment, in a game system comprising a game device including a game processing unit performing information processing concerning a game and a communication unit performing communication via a network, and a server including a communication unit performing communication with the game device via the network, the game device includes a purchase request transmission unit transmitting a purchase request for a first item to be used in the game to the server by communication through the communication unit, the server includes a purchase request reception unit receiving the purchase request transmitted by the purchase request transmission unit and a first item imparting unit imparting the first item in response to the purchase request received by the purchase request reception unit, and an upper limit is set for a cumulative number of the first items to be purchased, for a user who plays the game with the game device.

The object and advantages of the present technology herein will be realized and attained by means of the elements and combinations particularly pointed out in the claims. It is to be understood that both the foregoing general description and the following detailed description are exemplary and explanatory and are not restrictive of the technology herein.

The above and further objects and features of the present technology herein will more fully be apparent from the following detailed description with reference to the accompanying drawings.

DETAILED DESCRIPTION OF NON-LIMITING EXAMPLE EMBODIMENTS

Embodiment 1

(System Outline)

Figure 1:
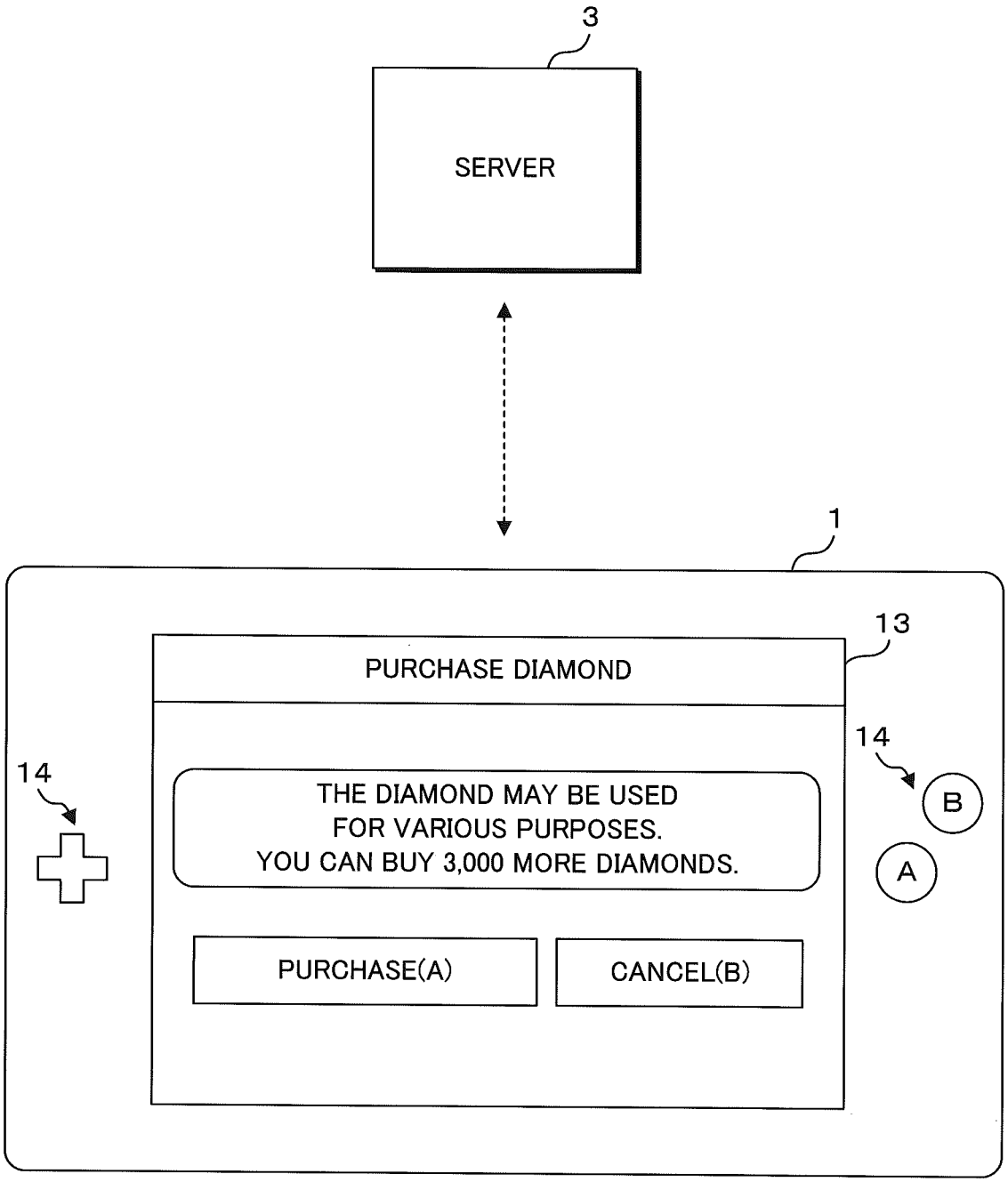
FIG. 1 shows an example non-limiting schematic view illustrating an outline of a game system according to a present example embodiment.

FIG. 1 shows an example non-limiting schematic view illustrating an outline of a game system according to the present example embodiment. The game system according to the present example embodiment includes one or more game devices 1 and a server 3. The game device 1 is a device for the user to operate it and play a game. FIG. 1 illustrates, as an example, a portable game device 1 which may be carried by the user. The game device 1 may also be a stationary device, not limited to a portable device. Such a configuration may also be possible that a game application is executed in a general-purpose personal computer (PC), a smartphone, a tablet terminal device or the like to utilize the device as the game device 1. In other words, the game device 1 may be a versatile information processing device, not necessarily a dedicated game machine.

The illustrated game device 1 is so configured that a display unit 13, an operation unit 14 and the like are arranged on a surface of a casing having a substantially rectangular plate-like shape. The display unit 13 is constituted by a liquid-crystal panel or the like. The display unit 13 displays various images such as a home screen and a game screen thereon. In the illustrated game device 1, a diamond purchasing screen is displayed for selling diamonds that are used as virtual currency in a game according to the present example embodiment. The operation unit 14 is constituted by using, for example, one or more buttons or switches. The operation unit 14 accepts various types of operations such as a game operation, a selecting operation, a deciding operation and a canceling operation performed by the user. The operation unit 14 in the illustrated game device 1 includes a cross key located at the left side of the display unit 13 and two push buttons located at the right side thereof. The push button denoted by the letter "A" is referred as a "button A" whereas the push button denoted by the letter "B" is referred to as a "button B." The game device 1 has a function of communicating with the server 3 through a wired or wireless network.

The game concerning the present example embodiment offers a program, data and the like executed by the game device 1 free of charge. For example, a recording medium such as a disk or a memory card in which the program, data and the like of a game is distributed free of charge. For example, the program, data and the like may be downloaded free through a specific homepage. The user executes the program, data and the like obtained free of charge with the game device 1, to play a game for free. Furthermore, a game according to the present example embodiment may be played to the end (i.e. be cleared) by the user without any additional fee.

In the game according to the present example embodiment, a "diamond" is used as virtual currency in the game. For example, a predetermined number of "diamonds" are imparted to the user who satisfied a predetermined condition during a game. The user may use the imparted "diamond" in the game to, for example, purchase an accessory of a character in the game and an additional scenario of the game.

The user may also purchase "diamond." In such a case, the user does not purchase "diamond" by a payment of virtual currency in the game but purchases "diamond" by a payment of money in the real world. The user operates the game device 1 to select a column of "purchase diamond" on the menu screen of a game, for example, to display a diamond purchasing screen illustrated in FIG. 1 on the display unit 13 of the game device 1. Here, the game device 1 performs, for example, settlement processing concerning sales of "diamond" through communication with the server 3. After the processing with the server 3, the game device 1 imparts desired "diamond" to the user. That is, the game according to the present example embodiment is a game which employs a charging method of item charging in which the "diamond" as an item used as virtual currency in the game is sold for a fee. The user makes a payment for purchased "diamond" by utilizing, for example, a credit card, prepaid card or the like.

It is to be noted that, in the game system according to the present example embodiment, the server 3 performs processing concerning the sales of "diamond" through communication with the game device 1, but does not perform processing related to a game played by the user with the game device 1. In other words, the game device 1 communicates with the server 3 when performing processing concerning the sales of "diamond," but performs the other processing in the game by itself without the need for communicating with the server 3. The server 3 may, however, have a configuration of performing the processing concerning a game by sharing it with the game device 1.

In the game system according to the present example embodiment, the number of "diamonds" that can be purchased by one user has an upper limit. The upper limit for the number of "diamonds" to be purchased is not set for one purchase. That is, no such a limit is set that, for example, up to one hundred "diamonds" can be purchased for one purchase. In the game system according to the present example embodiment, the cumulative number of "diamonds" that have been purchased by the user is managed, and an upper limit is provided for the cumulative number. For example, an upper limit of one thousand is set for the cumulative number of purchased "diamonds." In such a case, the user may repeat one hundred actions of purchasing ten "diamonds" at a time, for example. After that, the user cannot purchase any more "diamonds" as the cumulative number reaches the upper limit. The user may also purchase one thousand "diamonds" at a time, for example. After that, the user cannot purchase any more "diamonds," since the cumulative number reaches the upper limit.

As described above, in the game system according to the present example embodiment, an upper limit is provided for the cumulative number of "diamonds" that can be purchased by one user. This means that the amount of money spent for this game by one user has an upper limit. This can prevent one user from continuously purchasing items and thereby spending a vast amount of money for item charging. Informing of an upper limit provided for item charging can offer a feeling of security to a user who is playing the game or a user who is about to play the game.

(System Configuration)

Figure 2:
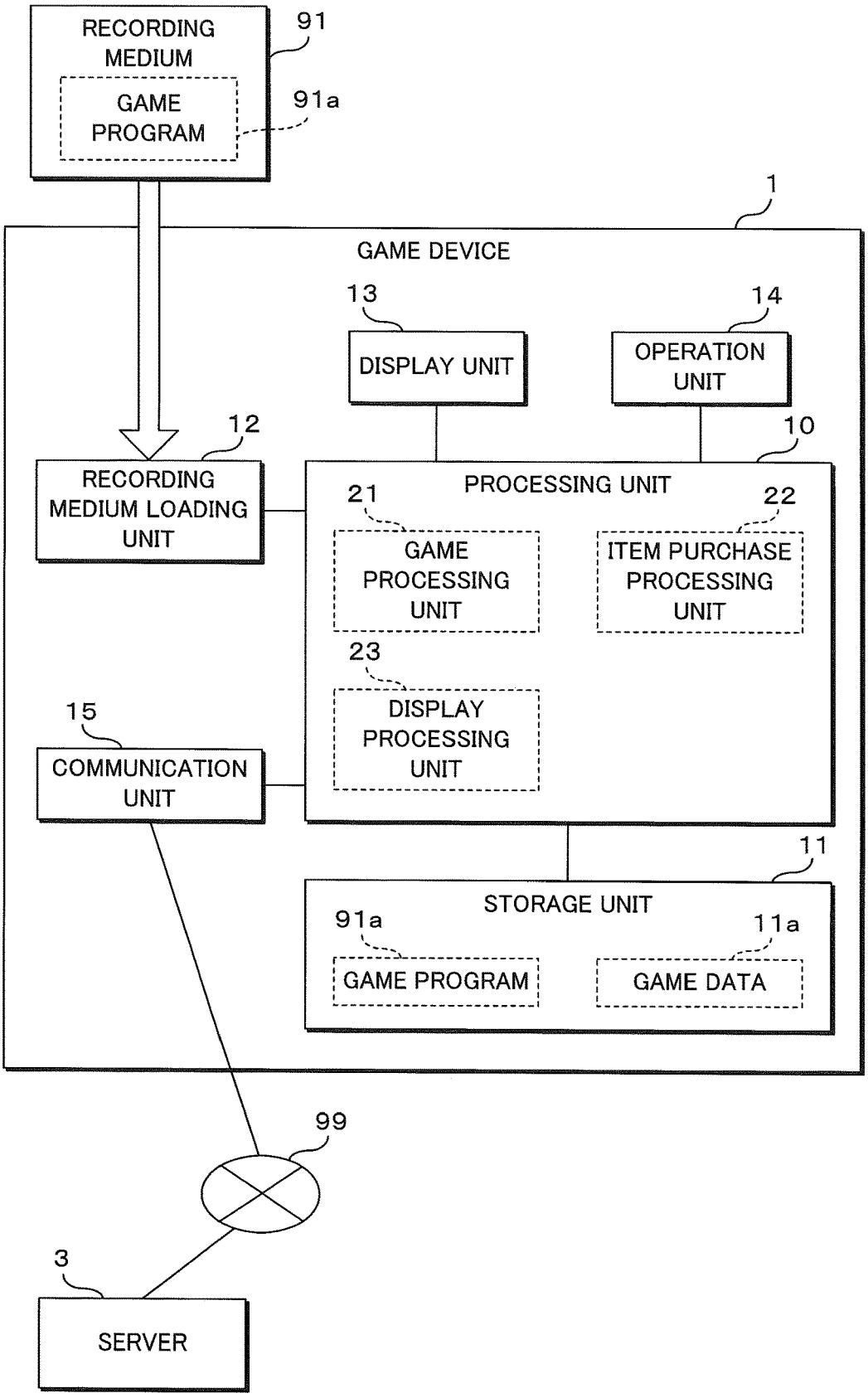
FIG. 2 shows an example non-limiting block diagram illustrating a configuration of a game device.

FIG. 2 shows an example non-limiting block diagram illustrating a configuration of the game device 1. The game device 1 according to the present example embodiment includes a processing unit (processor) 10, a storage unit 11, a recording medium loading unit 12, a display unit 13, an operation unit 14, a communication unit 15 and so forth. The processing unit 10 of the game device 1 is configured using an arithmetic processing device such as a central processing unit (CPU). The processing unit 10 reads out and executes a game program 91*a* recorded in a recording medium 91 loaded to the recording medium loading unit 12, or a game program 91*a* stored in the storage unit 11. Accordingly, the processing unit 10 performs various types of information processing such as processing concerning a game and processing concerning item purchasing.

The storage unit 11 is configured using a volatile or non-volatile semiconductor memory device, a hard disk drive or the like. The storage unit 11 stores therein various programs such as the game program 91*a* as well as game data 11*a* required for executing the game program 91*a*, for example. For example, the game data 11*a* is so-called saved data in a game. In the present example embodiment, however, information related to the number of "diamonds" possessed by the user is stored in the game data 11*a*. The recording medium loading unit 12 is so configured that the recording medium 91 of a card type, cassette type, disk type or the like may be loaded thereto or removed therefrom. The processing unit 10 may read out the game program 91*a* and various kinds of data from the recording medium 91 loaded to the recording medium loading unit 12. Another configuration may also be possible in that the processing unit 10 may write a program, data or the like to the recording medium 91.

The display unit 13 is configured using a liquid-crystal panel or the like, and displays an image transmitted from the processing unit 10. The operation unit 14 includes a cross key, a push button and the like as illustrated in FIG. 1, and accepts an operation performed by the user. The operation unit 14 may also be configured to include a touch panel on the display unit 13 and to accept contact operation of the user with respect to the image displayed on the display unit 13. The operation unit 14 transmits the content of operation performed by the user, for example, a signal in accordance with pressing-down, releasing or the like of a button, to the processing unit 10. The communication unit 15 transmits/receives information to/from the server 3, another game device 1 or the like via a network 99 such as a wireless local area network (LAN), a mobile phone communication network or the Internet. For example, the game device 1 may communicate with the server 3 through the communication unit 15 to download the game program 91*a* or the like and store it in the storage unit 11.

In the game device 1 according to the present example embodiment, the processing unit 10 executes the game program 91*a*, so that a game processing unit 21, an item purchase processing unit 22, a display processing unit 23 and the like are implemented by the processing unit 10 as software functional blocks. In response to the operation of the user accepted by the operation unit 14, the game processing unit 21 performs, for example, various determination processing or event processing related to a game. The item purchase processing unit 22 communicates with the server 3 through the communication unit 15 to perform processing related to the purchase of "diamond" described above. The item purchase processing unit 22 performs, for example, processing of transmitting a purchase request for "diamond" to the server 3, settlement processing required for a purchase and processing of reflecting the result of purchased "diamond" in a game. In accordance with the processing performed at the processing unit 10, the display processing unit 23 generates various kinds of images such as a game screen or a diamond purchasing screen, for example. The display processing unit 23 sends the generated image to the display unit 13 to display an image on the display unit 13.

Figure 3:
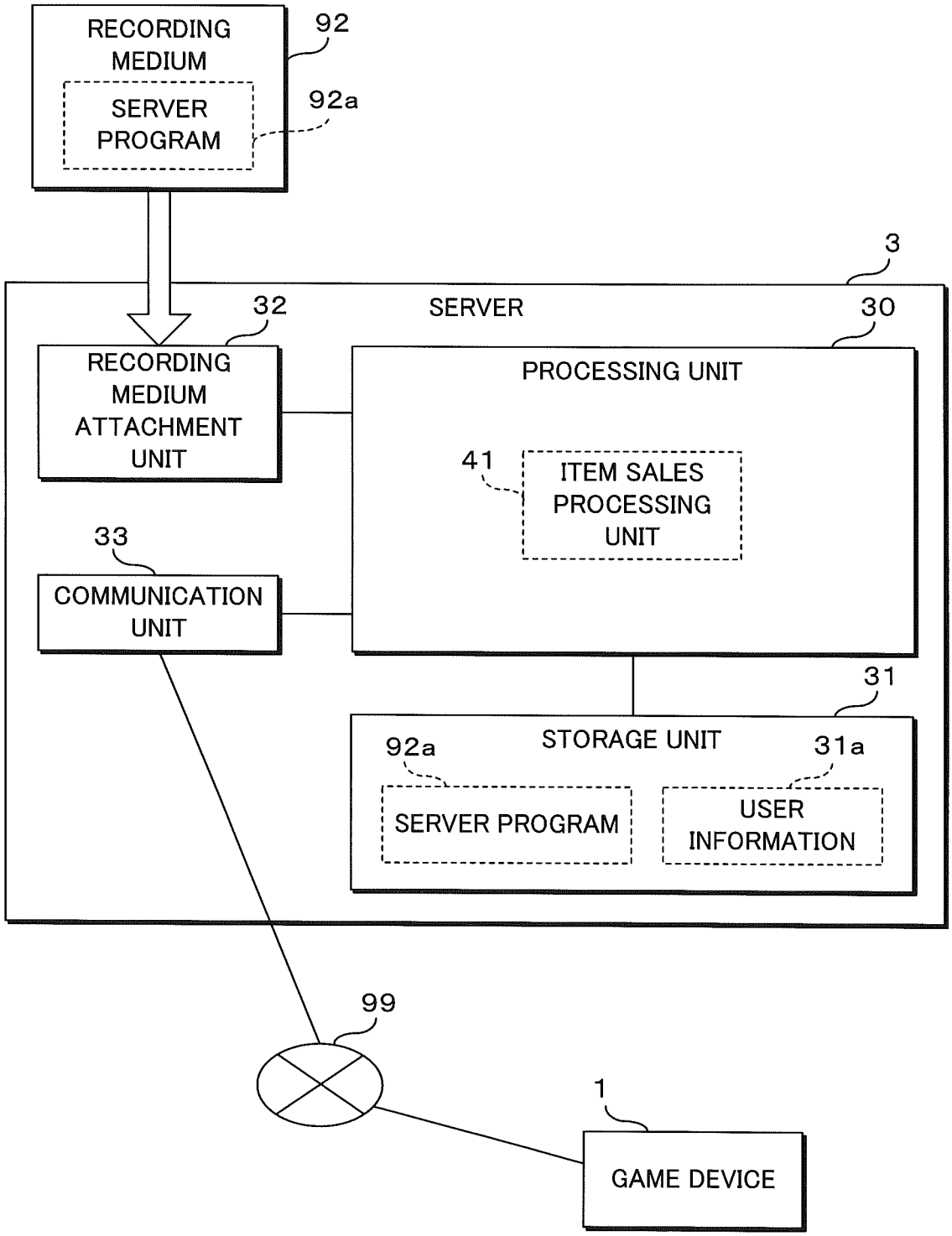
FIG. 3 shows an example non-limiting block diagram illustrating a configuration of a server.

FIG. 3 shows an example non-limiting block diagram illustrating a configuration of the server 3. The server 3 according to the present example embodiment includes a processing unit (processor) 30, a storage unit 31, a recording medium attachment unit 32, a communication unit 33 and so forth. The processing unit 30 is constituted by an arithmetic processing device such as a CPU. The processing unit 30 reads out and executes a server program 92*a* stored in the storage unit 31 to perform various types of processing concerning sales of items. The storage unit 31 is configured using a non-volatile storage device. The storage unit 31 may store a program such as the server program 92*a* as well as various kinds of data. In the present example embodiment, the storage unit 31 stores therein information related to the user who plays a game with the game device 1, as user information 31*a*.

The recording medium loading unit 32 is so configured that the recording medium 92 of a disk type or the like may be loaded thereto or removed therefrom. The processing unit 30 may read out the server program 92*a* as well as other various kinds of data from the recording medium 92 loaded to the recording medium loading unit 32 and install them in the storage unit 31. The communication unit 33 transmits/receives information to/from the game device 1 or another server via the network 99 such as the Internet.

In the server 3 according to the present example embodiment, the processing unit 30 executes the server program 92*a* so that an item sales processing unit 41 or the like is implemented as a software functional block. The item sales processing unit 41 communicates with the game device 1 through the communication unit 33 to perform processing related to the sales of "diamond" described above. The item sales processing unit 41 performs processing of, for example, receiving a purchase request for "diamond" from the game device 1. The item sales processing unit 41 performs settlement processing required for sales. The item sales processing unit 41 performs processing of imparting sold "diamond" to the user of the game device 1. The item sales processing unit 41 performs processing of storing the cumulative number of purchased "diamonds" for each user under the user information 31*a* in the storage unit 31. The item sales processing unit 41 performs processing of limiting the sales of "diamond" based on the stored cumulative number.

While the present example embodiment described a configuration in which the server 3 stores the cumulative number of purchased "diamonds" for each user and the sales of "diamond" is limited based on the cumulative number, the configuration is not limited thereto. Another configuration may also be employed in which the game device 1 stores the cumulative number of purchased "diamonds" for each user and the sales of "diamond" is limited based on the cumulative number.

(Sales and Purchase of Diamonds)

A game implemented by the game device 1 according to the present example embodiment executing the game program 91*a* may include various games such as, for example, an action game, a roll-playing game, a simulation game or a puzzle game. It is to be noted that, in the game according to the present example embodiment, virtual currency of "diamond" which can be used during a play in the game is provided to the user. The user uses (consumes) "diamond" during a play in the game to purchase, for example, an accessory of a character and an additional scenario of a game. The user may obtain an effect of, for example, proceeding with a game advantageously, proceeding with a game fast or enjoying an additional element of a game by the use of "diamond."

In the game according to the present example embodiment, the user may obtain "diamond" free of charge. For example, one "diamond" a day is imparted to the user who plays the game with the game device 1. For example, a predetermined number, e.g., ten "diamonds" may be imparted to the user at the time point of starting the game. For example, a predetermined number of "diamonds" may be imparted to the user at a specific event or when a condition is satisfied in the game. In the game according to the present example embodiment, the number of "diamonds" imparted free of charge under such a specific condition is limited to a small number in the range of one to several "diamonds" a day.

In the game according to the present example embodiment, the user may purchase non-free "diamond" for a fee. The non-free "diamond" has no limit for the number to be purchased at a time except that there is an upper limit for the cumulative number of purchased "diamonds" as described above. The user may purchase any number of non-free "diamonds" any number of times unless the cumulative number reaches the upper limit. The "diamond" purchased for a fee is the same as the "diamond" obtained free, and both are treated in the game without discriminating one from another. By purchasing non-free "diamond," the user may more advantageously and more rapidly proceed with the game.

In the case of purchasing "diamond," the user operates the game device 1 to select the column of "purchase diamond" on a menu screen or the like of the game. The processing unit 10 of the game device 1 which accepted the selecting operation for "purchase diamond" performs communication between the item purchase processing unit 22 and the server 3 through the communication unit 15 to exchange information. Thereafter, the display processing unit 23 displays the diamond purchasing screen illustrated in FIG. 1 on the display unit 13. Here, the item purchase processing unit 22 of the game device 1 transmits information such as a user ID assigned to the user to the server 3. The item purchase processing unit 22 obtains, from the server 3, information related to how many "diamonds" the user is able to purchase.

Here, the server 3 refers to the user information 31*a* in the storage unit 31 based on the user ID received from the game device 1 to find the cumulative number of "diamonds" purchased by the user. The server 3 compares the set upper limit for purchasing "diamonds" with the cumulative number of "diamonds" purchased by the user. The server 3 calculates the number of "diamonds" that can be purchased by the user, and transmits the calculated purchasable number to the game device 1. On the diamond purchasing screen illustrated in FIG. 1, a title of "purchase diamond" is displayed at the upper part. At the middle part of the diamond purchasing screen, a message indicating "The diamond may be used for various purposes. You can buy 3,000 more diamonds" is displayed. At the lower part of the diamond purchasing screen, a "purchase" button and a cancel button are displayed. The message at the middle part is a message for notifying the user of the purchasable number received from the server 3.

The "purchase" button on the diamond purchasing screen is associated with the button A of the operation unit 14, whereas the cancel button is associated with the button B. In the case where an operation is performed for the cancel button, the processing unit 10 of the game device 1 returns the display from the diamond purchasing screen to the menu screen of the game or the like. In the case where the operation is performed for the "purchase" button, the processing unit 10 of the game device 1 displays on the display unit 13 a purchase number selecting screen for accepting a selection related to the number of "diamonds" to be purchased.

Figure 4:
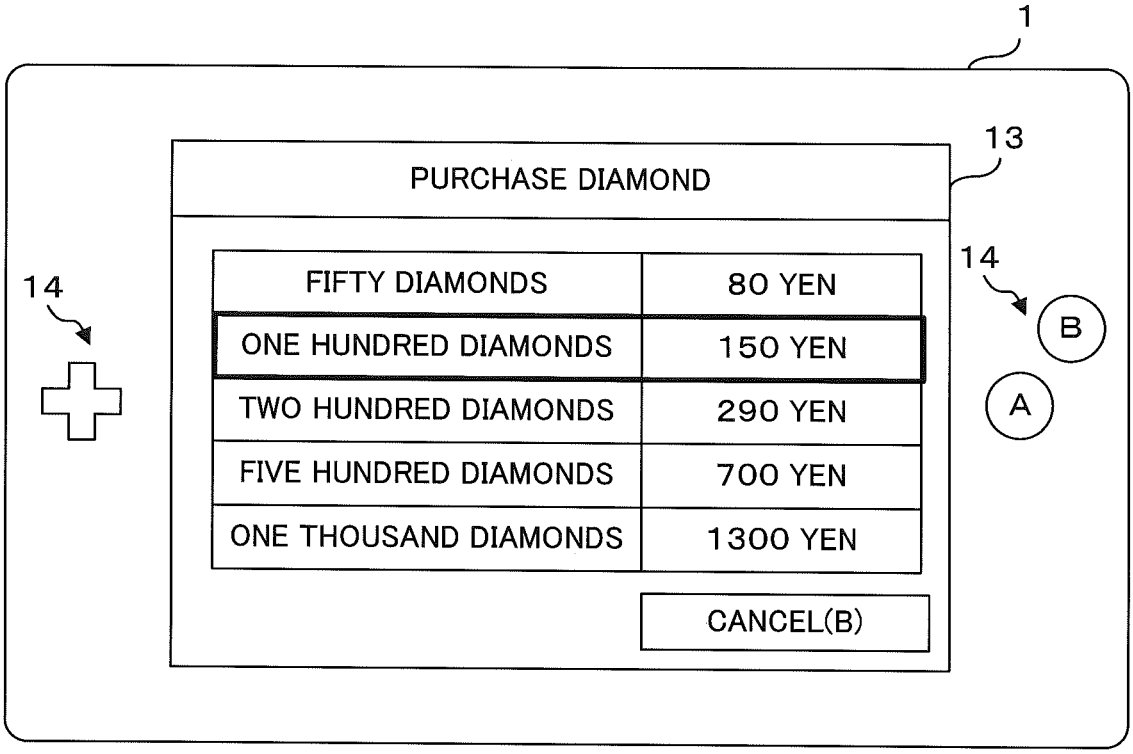
FIG. 4 shows an example non-limiting schematic view illustrating a purchase number selecting screen displayed by a game device.

FIG. 4 shows an example non-limiting schematic view illustrating a purchase number selecting screen displayed by a game device 1. On the purchase number selecting screen, the number of "diamonds" to be purchased and the price thereof are displayed as a list in association with each other. The illustrated example indicates that the user can purchase fifty "diamonds" for 80 yen. Moreover, the user can purchase one hundred "diamonds" for 150 yen. The user can purchase two hundred "diamonds" for 290 yen. The user can purchase five hundred "diamonds" for 700 yen. The user can purchase one thousand "diamonds" for 1,300 yen. It is to be noted that the game device 1 either does not display in the list the number of "diamonds" that cannot be purchased by the user, or displays it in such a manner that can be identified as not purchasable by the user, based on the number of purchasable "diamonds" received from the server 3. For example, in the case where the purchasable number is eight hundred, the game device 1 does not have to display the selection column related to one thousand "diamonds." On the purchase number selecting screen, the title of "purchase diamond" is displayed at the upper part, the association between the numbers of diamonds and the prices thereof is displayed as a list at the middle part, and a cancel button is displayed at the lower part.

In the game system according to the present example embodiment, the unit price for a "diamond" is not fixed but is lowered as the number of "diamonds" to be purchased at the same time is increased. For example, in the case of purchasing fifty "diamonds," the unit price for a "diamond" is 1.6 yen. In the case of purchasing one hundred "diamonds," the unit price of a "diamond" is 1.5 yen. In the case of purchasing two hundred "diamonds," the unit price for a "diamond" is 1.45 yen. In the case of purchasing five hundred "diamonds," the unit price for a "diamond" is 1.4 yen. In the case of purchasing one thousand "diamonds," the unit price for a "diamond" is 1.3 yen. Thus, in the game system according to the present example embodiment, such a discount is offered that the unit price is lowered as the number of "diamonds" to be purchased is increased, which may urge the user to purchase a larger number of "diamonds."

By operating the cross key at the operation unit 14 of the game device 1 up and down, the user may move the cursor in the purchase number selecting screen up and down to select the number of "diamonds" to be purchased. The cursor in FIG. 4 is indicated as a horizontally-long rectangle with a thick line. In the case where an operation is performed for the cancel button on the purchase number selecting screen, the processing unit 10 of the game device 1 returns from the purchase number selecting screen to the menu screen in the game. In the case where an operation is performed for the button A of the operation unit 14 on the purchase number selecting screen, the processing unit 10 of the game device 1 decides, with the cursor, the selection of the number of "diamonds" to be purchased, and displays a confirmation screen for a final confirmation of the purchase on the display unit 13.

Figure 5:
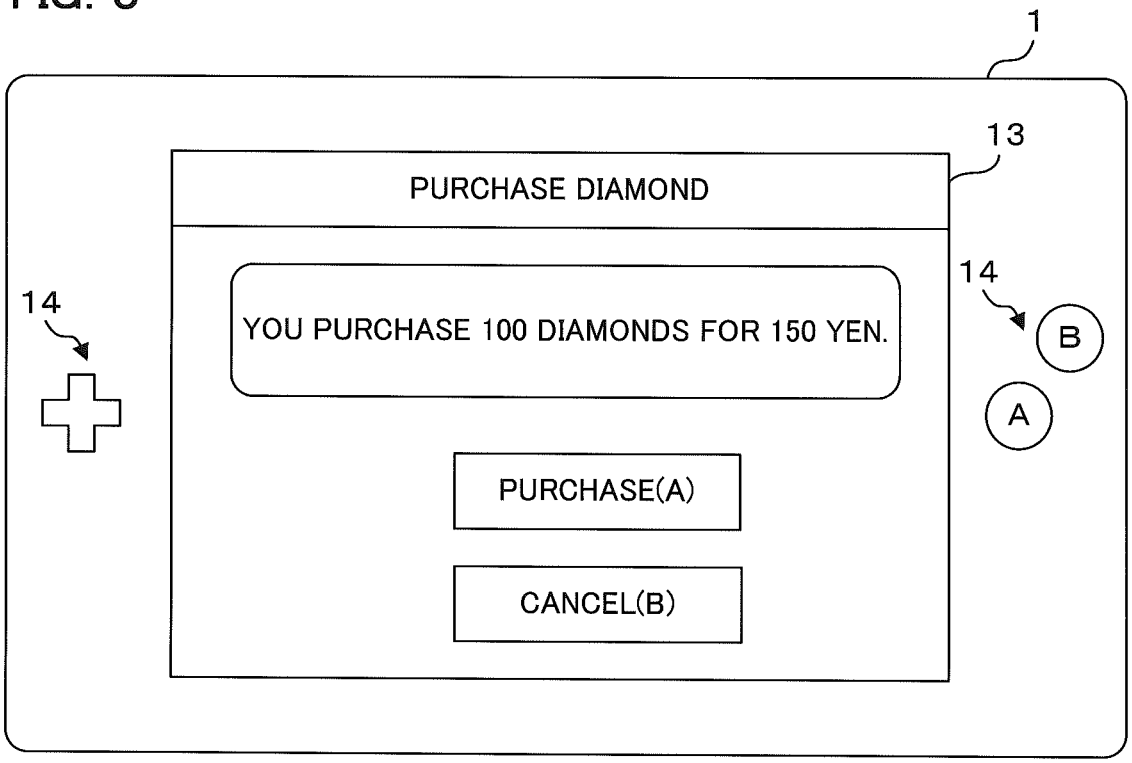
FIG. 5 shows an example non-limiting schematic view illustrating an example of a confirmation screen displayed by a game device.

FIG. 5 shows an example non-limiting schematic view illustrating an example of a confirmation screen displayed by the game device 1. In the confirmation screen, the title of "purchase diamond" is displayed at the upper part. At the middle part of the confirmation screen, a confirmation message is displayed. At the lower part of the confirmation screen, a "purchase" button and a cancel button are displayed. The present example illustrates the case where a selection of purchasing one hundred "diamonds" is made on the purchase number selecting screen in FIG. 4. Thus, the message at the middle part describes a sentence indicating that "You purchase 100 diamonds for 150 yen." In the case where an operation for the cancel button is performed on the confirmation screen, the processing unit 10 of the game device 1 returns from the confirmation screen to the purchase number selecting screen illustrated in FIG. 4. In the case where an operation is performed for the "purchase" button on the confirmation screen, the processing unit 10 of the game device 1 transmits, to the server 3, a request for purchasing "diamonds" by designating the number of "diamonds" to be purchased.

The item sales processing unit 41 of the server 3 which received the purchase request from the game device 1 compares the number of "diamonds" requested to be purchased with the number of purchasable "diamonds" based on the cumulative number of "diamonds" for the user and the upper limit thereof, and determines whether or not the requested number of "diamonds" can be purchased. If it is determined that the requested number of "diamonds" can be purchased, the item sales processing unit 41 communicates through the communication unit 33 with the game device 1 which made the purchase request, and performs settlement processing for a payment of the price for "diamond." After the settlement processing is normally completed, the item sales processing unit 41 transmits to the game device 1 a notification that the "diamond" requested to be purchased is imparted to the user. The game device 1 that received the notification of imparting "diamond" from the server 3 updates information concerning the number of "diamonds" contained in the game data 11*a* in the storage unit 11 so as to increase the number of "diamonds" possessed by the user. Accordingly, the processing related to the sales and purchase of "diamond" are terminated, which allows the user to use the purchased "diamond" in the game.

If the item sales processing unit 41 of the server 3 determines that the number of "diamonds" requested from the game device 1 cannot be purchased, the purchase of "diamond" is limited by notifying the game device 1 that the purchase is not allowed. In such a case, the server 3 terminates the processing without performing settlement processing or the like with the game device 1. The game device 1 displays an error message or the like on the display unit 13 in accordance with the notification of unallowable purchase from the server 3.

The game system according to the present example embodiment may have a configuration in which the number of "diamonds" that cannot be purchased is not displayed as a list or is displayed in such a manner for the user to be able to identify that the purchase is not allowed in the purchase number selecting screen illustrated in FIG. 4. The game system according to the present example embodiment has a configuration of determining whether or not the server 3 may be purchased in response to the purchase request from the game device 1. Both of these configurations are for limiting a purchase in accordance with the cumulative number of "diamonds," and are functionally overlapped with each other. The game system according to the present example embodiment further ensures the limitations in the purchase by applying these two types of limitations together. The game system may, however, also be configured to apply either one of the limitations.

(Award Imparting)

In the game system according to the present example embodiment, a predetermined award is imparted to the user who purchased "diamonds" up to the limit of the purchasable number. The predetermined award is, for example, a right to receive twenty free "diamonds" a day. This right may be expressed in a game by an item such as a "diamond excavator" which can be used once a day. In the game system according to the present example embodiment, the user who purchased "diamonds" up to the upper limit cannot purchase any more "diamonds" thereafter. The user may have difficulty in taking actions that require "diamonds" during a game after expending all the purchased "diamonds." To avoid this, in the game system according to the present example embodiment, an award as described above is imparted to the user to continuously impart "diamonds" for free. By informing the existence of such an award, the user may be urged to purchase "diamonds" up to the upper limit.

It is to be noted that the predetermined award is not limited to the imparting of twenty "diamonds" a day. The number of "diamonds" to be imparted may also be lower or higher than twenty, and may appropriately be set in accordance with the content of the game. The "diamond" may not necessarily be imparted at an interval of one day but may also be imparted at an interval such as one "diamond" an hour or one hundred "diamonds" a week, for example. It is also possible not to apply limitations on the imparting intervals and imparting number. Instead, a predetermined number of "diamonds" may be imparted every time the "diamond excavator" is used in the game while the "diamond excavator" may be used without any limitations. The predetermined award may be anything which allows the user who cannot purchase anymore "diamonds" to obtain free "diamonds" by some means.

For example, in the case where the number of purchased "diamonds" has reached the upper limit, the processing unit 30 of the server 3 notifies the game device 1 that an award is to be imparted. The processing unit 10 of the game device 1 that received the notification of award imparting from the server 3 displays on the display unit 13 an image of a "diamond excavator" or the like imparted as an award item (the second item) together with a message indicating that an award is imparted. The processing unit 10 of the game device 1 adds information indicating that the user possesses the "diamond excavator" as an item to the game data 11*a* stored in the storage unit 11 and stores the information. Thereafter, the user performs a predetermined operation with the use of the operation unit 14 during the game to use the "diamond excavator." The processing unit 10 of the game device 1 accepts the predetermined operation by the user and, if the predetermined operation is performed, notifies the user that the item is used by displaying the "diamond excavator" on the display unit 13.

In the case where the "diamond excavator" is used, the processing unit 10 of the game device 1 imparts a predetermined number of "diamonds" to the user without communicating with the server 3. The processing unit 10 imparts the predetermined number of "diamonds" by increasing, by the predetermined number, the number of possessed "diamonds" contained in the game data 11*a* stored in the storage unit 11.

In the game system according to the present example embodiment, another award is imparted to the user who purchased "diamonds" up to the upper limit of the purchasable number. The second award is the right to reduce the number of consumed "diamonds" for the action of consuming "diamonds" during a game. For example, in the case where five "diamonds" need to be consumed for the purchase of an accessory of a character in a game, the second award may be implemented by a method of, for example, making the accessory purchasable by the consumption of one "diamond." The second award may be expressed as an item such as a "discount ticket" or the like in the game.

As for the second award, a configuration may also be employed in that the consumption of "diamonds" is reduced to zero. In such a case, the first award which continuously imparts free "diamonds" may be unnecessary.

(Flowchart)

Figure 6:
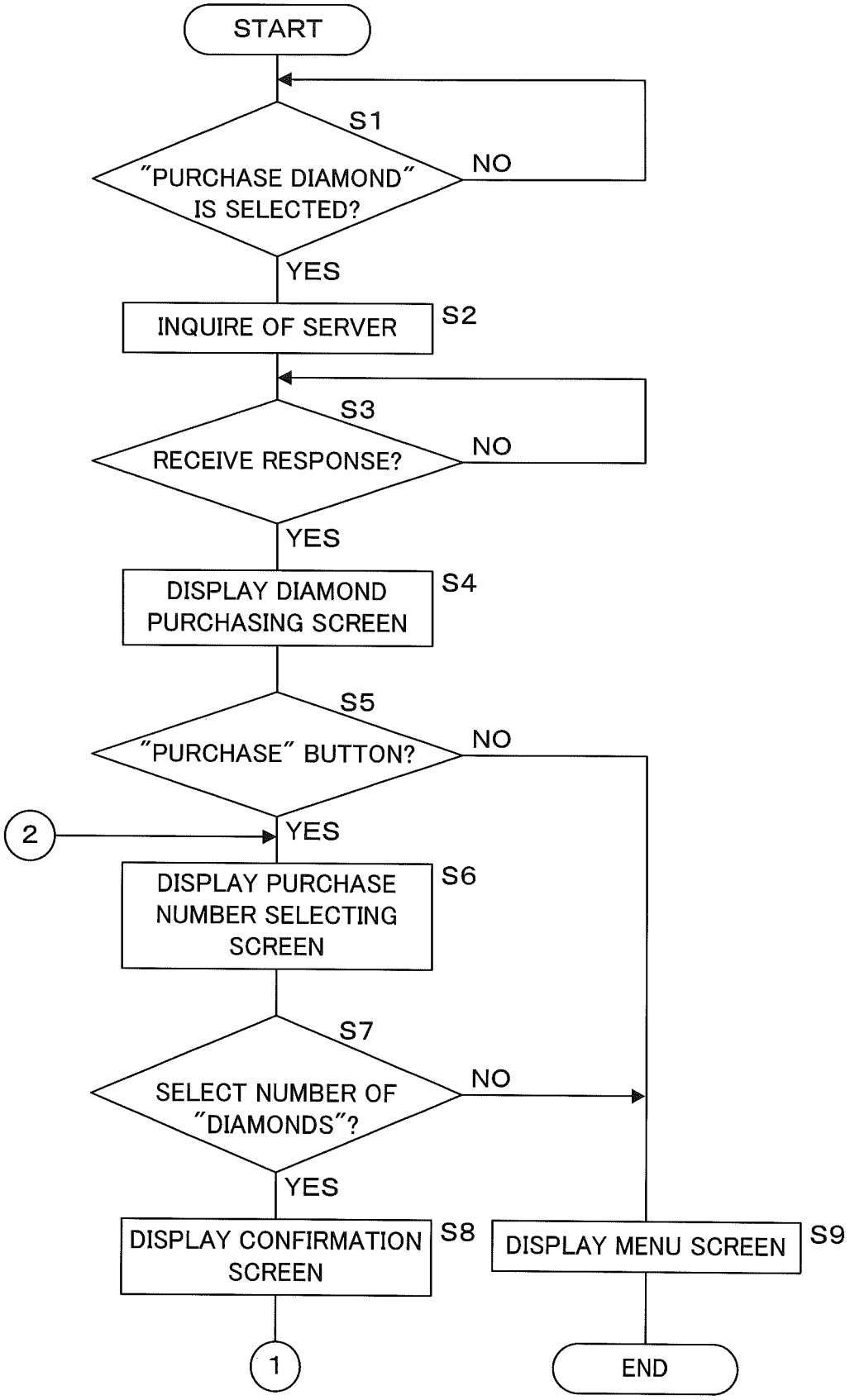
FIG. 6 shows an example non-limiting flowchart illustrating a procedure of "diamond" purchase processing performed by a game device.
Figure 7:
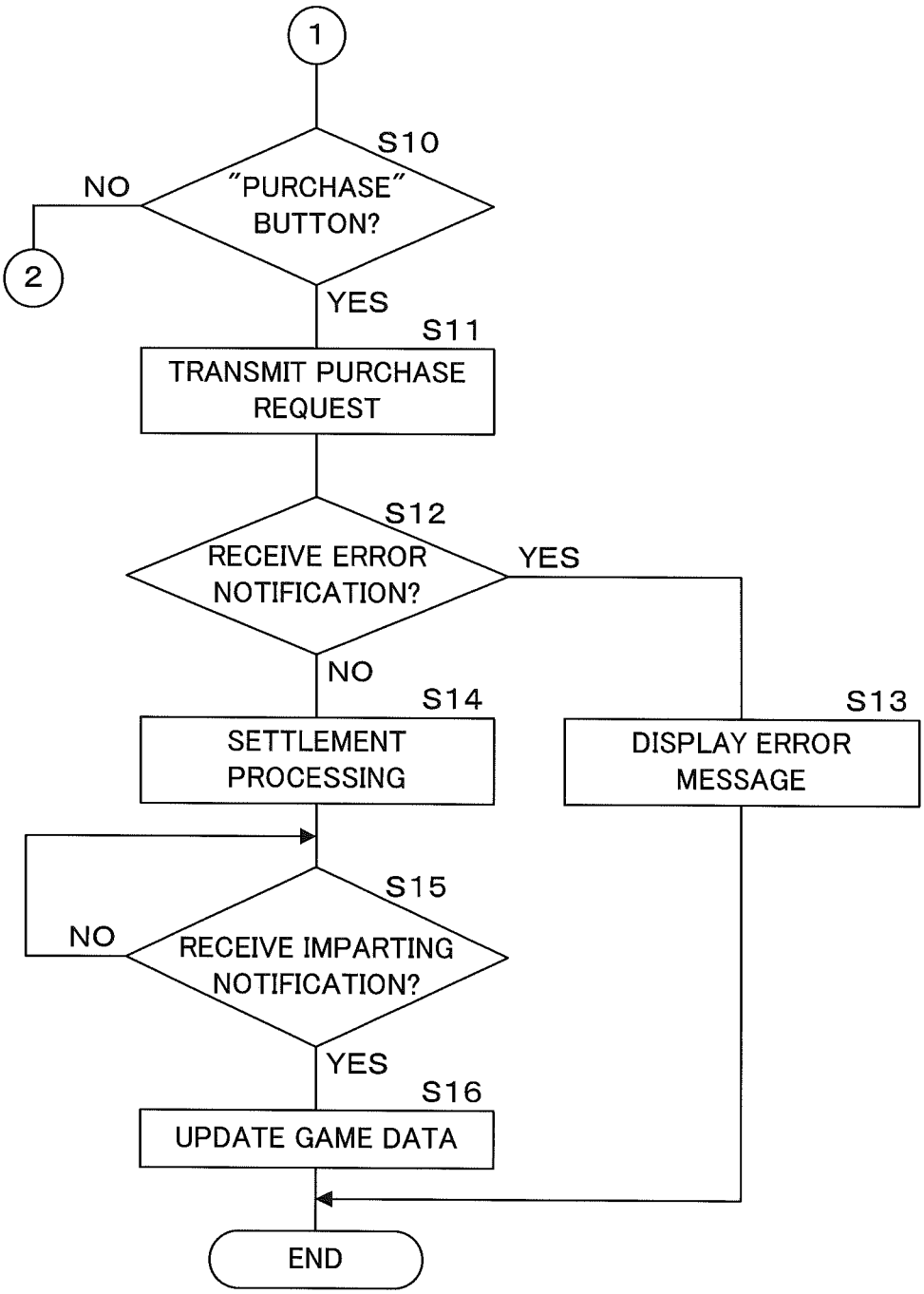
FIG. 7 shows an example non-limiting flowchart illustrating a procedure of "diamond" purchase processing performed by a game device.

The processing performed by each device in the game system according to the present example embodiment will be described below with reference to flowcharts. FIG. 6 and FIG. 7 show an example non-limiting flowchart illustrating a procedure of "diamond" purchase processing performed by the game device 1. The processing unit 10 of the game device 1 executing the game program 91*a* displays on the display unit 13 a menu screen in the case where a predetermined operation is performed during a game. The menu screen includes a selection column for purchasing "diamond." The processing unit 10 of the game device 1 determines whether or not the column of "purchase diamond" is selected on the menu screen (step S1). If the column of "purchase diamond" is not selected (S1: NO), the processing unit 10 waits in the state where the menu screen is displayed until the column of "purchase diamond" is selected. Here, the processing unit 10 may perform processing concerning another selection column on the menu screen.

If the column of "purchase diamond" is selected (S1: YES), the item purchase processing unit 22 in the processing unit 10 performs communication with the server 3 via the network 99 through the communication unit 15, to inquire the number of purchasable "diamonds" for the user (step S2). The item purchase processing unit 22 determines whether or not a response from the server 3 to this inquiry is received by the communication unit 15 (step S3). If the response is not received (S3: NO), the processing unit 10 waits until the response is received. If the response is received (S3: YES), the display processing unit 23 in the processing unit 10 displays on the display unit 13 the diamond purchasing screen illustrated in FIG. 1 while indicating the number of purchasable "diamonds" contained in the received response (step S4).

In the state where the diamond purchasing screen is being displayed, the item purchase processing unit 22 in the processing unit 10 determines whether or not an operation for the "purchase" button is performed (step S5). If the "purchase" button is not performed (S5: NO), i.e. if an operation for the cancel button is performed on the diamond purchasing screen, the display processing unit 23 in the processing unit 10 displays a menu screen on the display unit 13 (step S9) and terminates the processing. If an operation for the "purchase" button is performed (S5: YES), the display processing unit 23 displays the purchase number selecting screen illustrated in FIG. 4 on the display unit 13 (step S6).

In the state where the purchase number selecting screen is being displayed, the item purchase processing unit 22 in the processing unit 10 determines whether or not an operation of selecting the number of "diamonds" to be purchased is performed (step S7). If the operation of selecting the number of "diamonds" to be purchased is not performed (S7: NO), i.e. if an operation for the cancel button is performed on the purchase number selecting screen, the display processing unit 23 in the processing unit 10 displays a menu screen on the display unit 13 (step S9), and terminates the processing. If the operation of selecting the number to be purchased is performed (S7: YES), the display processing unit 23 displays on the display unit 13 a confirmation screen illustrated in FIG. 5 (step S8).

In the state where a confirmation screen is being displayed, the item purchase processing unit 22 in the processing unit 10 determines whether or not an operation for the "purchase" button is performed (step S10). If the operation for the "purchase" button is not performed (S10: NO), i.e. if the operation for the cancel button is performed on the confirmation screen, the processing unit 10 returns the processing to step S6 and displays the purchase number selecting screen by the display processing unit 23. If the operation for the "purchase" button is performed (S10: YES), the item purchase processing unit 22 in the processing unit 10 performs communication with the server 3 through the communication unit 15. The item purchase processing unit 22 transmits a purchase request for "diamond" to the server 3 by designating the number of "diamonds" to be purchased (step S11). The item purchase processing unit 22 determines whether or not an error notification is received from the server 3 in response to the purchase request (step S12). If the error notification is received (S12: YES), the display processing unit 23 in the processing unit 10 displays an error message on the display unit 13 indicating that no "diamond" can be purchased (step S13), and terminates the processing.

If the error notification is not received (S12: NO), the item purchase processing unit 22 in the processing unit 10 performs settlement processing with the server 3 (step S14). After terminating the settlement processing, the item purchase processing unit 22 determines whether or not a notification of imparting "diamond" is received from the server 3 (step S15). If the imparting notification is not received (S15: NO), the item purchase processing unit 22 waits until the imparting notification is received. If the imparting notification is received (S15: YES), the item purchase processing unit 22 updates the game data 11*a* in the storage unit 11 so as to increase the number of "diamonds" possessed by the user based on the imparting notification (step S16), and terminates the processing.

Figure 8:
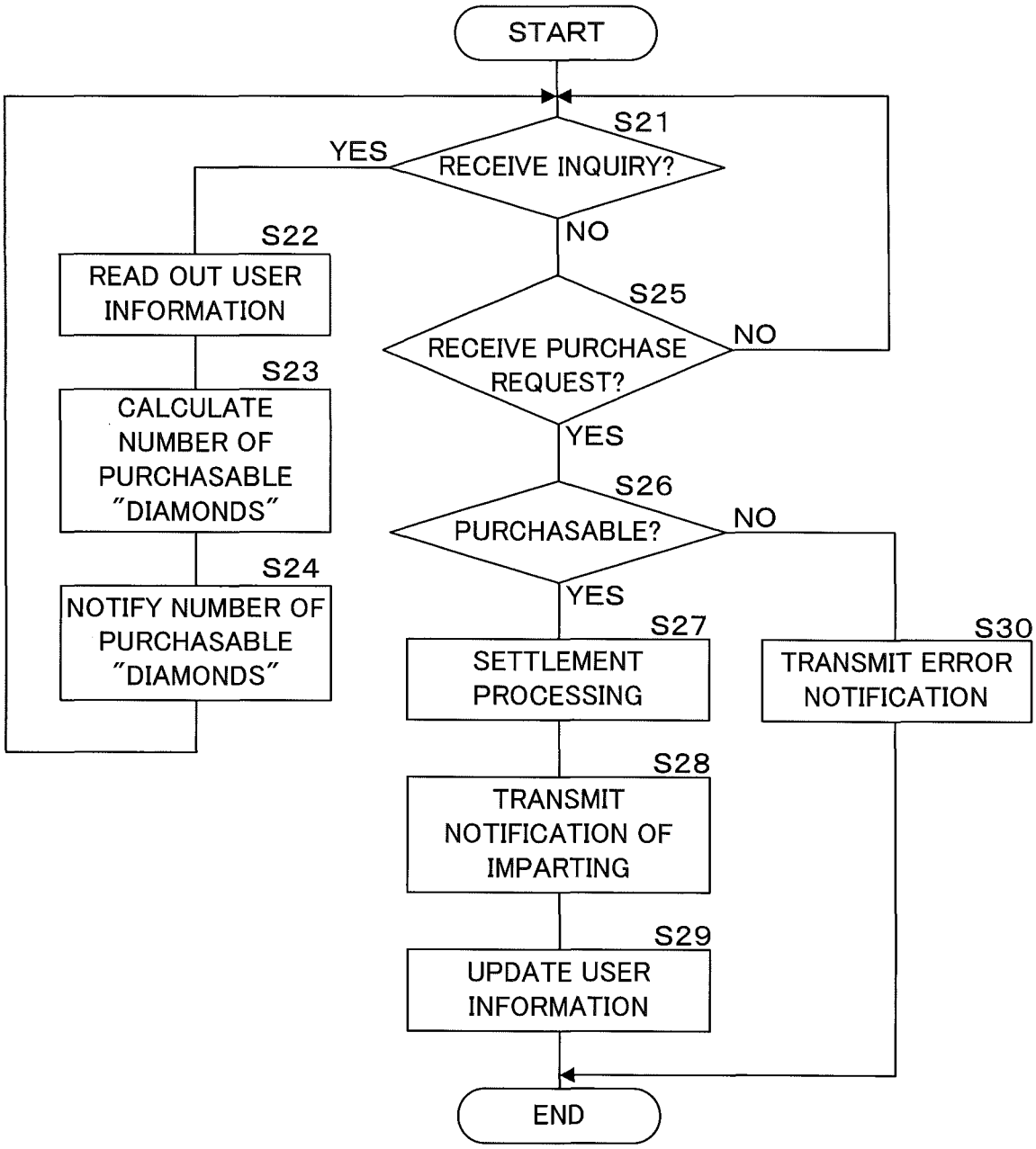
FIG. 8 shows an example non-limiting flowchart illustrating a procedure of "diamond" sales processing performed by a server.

FIG. 8 shows an example non-limiting flowchart illustrating a procedure of "diamond" sales processing performed by the server 3. The item sales processing unit 41 in the processing unit 30 of the server 3 determines whether or not an inquiry for the number of purchasable "diamonds" is received from the game device 1 through the communication unit 33 (step S21). If the inquiry is received (S21: YES), the item sales processing unit 41 reads out the user information 31*a* from the storage unit 31 (step S22). The item sales processing unit 41 obtains the cumulative number of "diamonds" purchased by the user concerning the inquiry from the user information 31*a*. The item sales processing unit 41 compares the set upper limit for purchasing "diamonds" with the cumulative number of purchased "diamonds" to calculates the number of "diamonds" purchasable by this user (step S23). The item sales processing unit 41 notifies the game device 1 which made the inquiry of the calculated number of purchasable "diamonds" (step S24), and returns the processing to step S21.

If the inquiry from the game device 1 is not received (S21: NO), the item sales processing unit 41 determines whether or not a purchase request for "diamond" is received from the game device 1 through the communication unit 33 (step S25). If the purchase request is not received (S25: NO), the item sales processing unit 41 returns the processing to step S21, and waits until the inquiry or purchase request is received from the game device 1. If the purchase request from the game device 1 is received (S25: YES), the item sales processing unit 41 compares the number of "diamonds" to be purchased that is attached to the purchase request with the purchasable number calculated at step S23 for this user. The item sales processing unit 41 determines whether or not the number of "diamonds" concerning the purchase request is purchasable (step S26).

If it is determined as purchasable (S26: YES), the item sales processing unit 41 performs settlement processing with the game device 1 (step S27). After terminating the settlement processing, the item sales processing unit 41 transmits a notification of imparting the requested number of "diamonds" to be purchased to the game device 1 through the communication unit 33 (step S28). The item sales processing unit 41 updates the user information 31*a* in the storage unit 31 so as to increase the cumulative number for the user who received the "diamond" (step S29), and terminates the processing. If it is determined that the requested number of "diamonds" is not purchasable (S26: NO), the item sales processing unit 41 transmits, through the communication unit 33, an error notification to the game device 1 which made the request (step S30), and terminates the processing.

Figure 9:
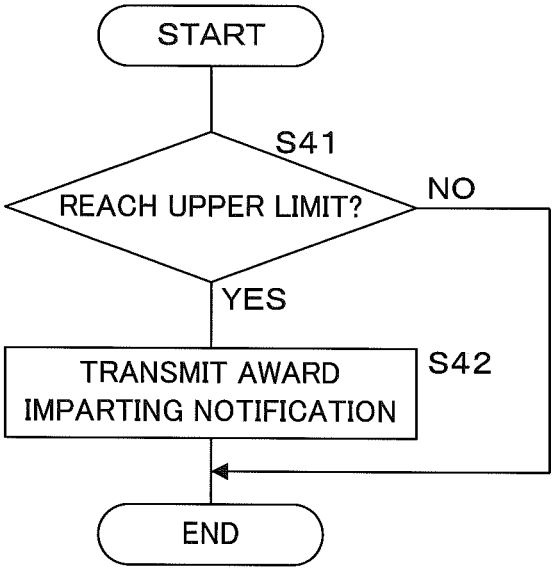
FIG. 9 shows an example non-limiting flowchart illustrating a procedure of award imparting processing performed by a server.

FIG. 9 shows an example non-limiting flowchart illustrating a procedure of award imparting processing performed by the server 3. Note that the award imparting processing illustrated in the flowchart is processing to be successively performed in the case where the user information 31*a* is updated at step S29 in the "diamond" sales processing illustrated in FIG. 8. The item sales processing unit 41 in the processing unit 30 of the server 3 determines whether or not the cumulative number has reached an upper limit for the user who purchased "diamond" based on the updated user information 31*a* (step S41). If the cumulative number of purchased "diamonds" has not reached the upper limit (S41: NO), the item sales processing unit 41 terminates the processing without imparting an award. If the cumulative number of purchased "diamonds" has reached the upper limit (S41: YES), the item sales processing unit 41 transmits a notification indicating that an award is imparted to the user to the game device 1 through the communication unit 33 (step S42), and terminates the processing.

Figure 10:
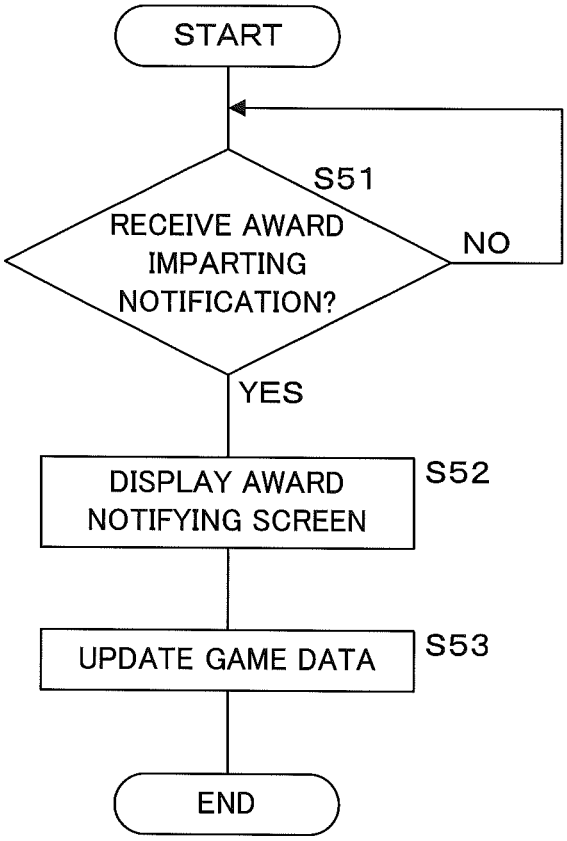
FIG. 10 shows an example non-limiting flowchart illustrating a procedure of award imparting processing performed by a game device.

FIG. 10 shows an example non-limiting flowchart illustrating a procedure of award imparting processing performed by the game device 1. The processing unit 10 of the game device 1 determines whether or not an award imparting notification is received from the server 3 through the communication unit 15 (step S51). If the award imparting notification is not received (S51: NO), the processing unit 10 waits for reception of the award imparting notification. If the award imparting notification is received (S51: YES), the processing unit 10 displays an award notifying screen (not illustrated) on the display unit 13 that notifies the user that an item such as a "diamond excavator" or "discount ticket," for example, is imparted as an award (step S52). The processing unit 10 updates the game data 11*a* in the storage unit 11 so as to add a notion that the user possesses the item imparted as an award (step S53), and terminates the processing.

Figure 11:
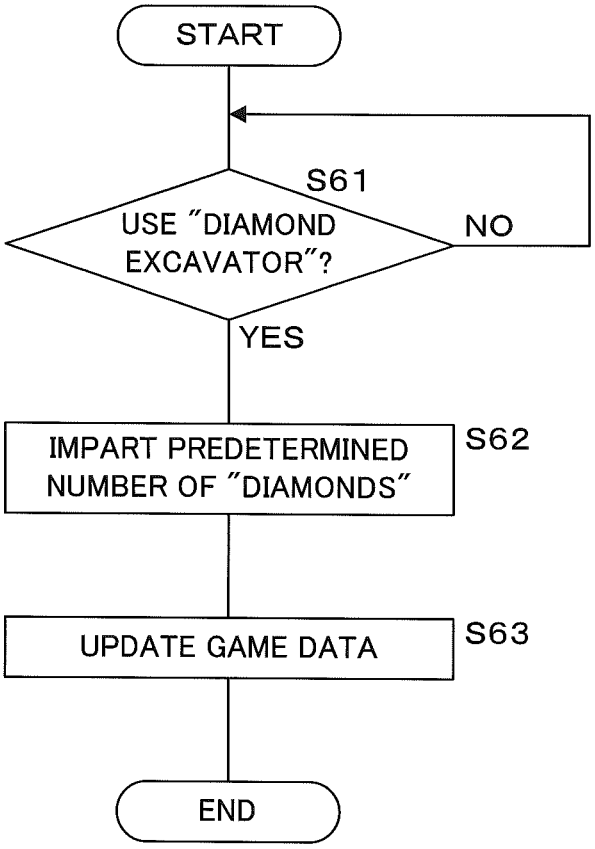
FIG. 11 shows an example non-limiting flowchart illustrating a procedure of processing concerning a "diamond excavator" performed by a game device.

FIG. 11 shows an example non-limiting flowchart illustrating a procedure of processing concerning a "diamond excavator" performed by the game device 1. The processing unit 10 of the game device 1 determines whether or not a predetermined operation is accepted at the operation unit 14 during a game, to determine whether or not an operation for using the "diamond excavator" is accepted (step S61). If the operation for using the "diamond excavator" is not accepted (S61: NO), the processing unit 10 waits until the operation are accepted. If the operation for using the "diamond excavator" is accepted (S61: YES), the processing unit 10 imparts a predetermined number of "diamonds" to the user (step S62). The processing unit 10 updates the game data 11*a* stored in the storage unit 11 so as to increase the number of "diamonds" possessed by the user, by the number of imparted "diamonds" (step S63), and terminates the processing.

CONCLUSION

The game system according to the present example embodiment with the configuration described above includes: the game device 1 having the game processing unit 21 performing information processing concerning a game and a communication unit 15 performing communication via the network 99; and the server 3 having the communication unit 33 performing communication with the game device 1 via the network 99, to purchase and sell an item "diamond" used in the game. In other words, the game system according to the present example embodiment is a system for implementing a game with so-called item charging. The item purchase processing unit 22 of the game device 1 transmits a request for purchasing "diamond" to the server 3 through communication by the communication unit 15. The item sales processing unit 41 of the server 3 receives a purchase request transmitted from the game device 1 and imparts "diamond" in response to the received purchase request. The game system according to the present example embodiment is so configured that an upper limit is set for the cumulative number of "diamonds" to be purchased for each user who plays the game with the game device 1 and no "diamond" exceeding this upper limit can be purchased.

Accordingly, in the game system according to the present example embodiment, an upper limit is set for the amount of money to be spent for a game by the user, preventing the user from spending a vast amount of money in item charging. Informing of an upper limit for item charging offers a feeling of security to a user who is playing the game or a user who is about to play the game.

In the game system according to the present example embodiment, an award is imparted to the user who purchased "diamonds" to the upper limit. The award to be imparted is a right to obtain "diamond" by satisfying a predetermined condition in a game, for example, a right to obtain free twenty "diamonds" a day. The award is a right for the user to continuously obtain "diamonds" without purchasing, which is a right for the user to comfortably play a game. Imparting of such an award can prevent the user, who cannot purchase anymore "diamonds" because the cumulative number of purchased "diamonds" has reached the upper limit, from having difficulty in taking an action that requires "diamond" in a game. By informing the existence of such an award, the user may be urged to purchase "diamonds" up to the upper limit.

The item to be purchased and sold in the game system according to the present example embodiment is "diamond" used as virtual currency in a game. The "diamond" is an item which can be obtained without purchasing in the game by, for example, imparting to the user one "diamond" a day. The "diamond" is an item which decreases in its possessed number when used, for example, to purchase an accessory of a character during a game.

In the game system according to the present example embodiment, a right is imparted to reduce the amount of consumption upon using "diamond" in a game as another award to the user who purchased "diamonds" up to the upper limit. This allows the game system to urge the user to purchase "diamond" since the user who purchased "diamonds" up to the upper limit may advantageously proceed with the game.

In the game system according to the present example embodiment, the price is adjusted such that the unit price for a "diamond" is lowered as the number of "diamonds" purchased at the same time is increased. This allows the game system to urge the user to purchase a larger number of "diamonds."

In the game system according to the present example embodiment, the number of "diamonds" that can be purchased by the user is displayed in the diamond purchasing screen displayed on the display unit 13 by the game device 1. This allows the user to easily grasp the purchasable number of "diamonds," which makes it possible for the user to smoothly purchase "diamond."

In the game system according to the present example embodiment, the server 3 stores the cumulative number of purchased "diamonds" for each user under the user information 31*a* in the storage unit 31. The server 3 limits the purchase of "diamond" by the user based on the stored cumulative number and the defined upper limit. The server 3 calculates the purchasable number of "diamonds" based on the cumulative number and upper limit. The server 3 issues an error notification in the case where a request for purchasing the number of "diamonds" exceeding the calculated purchasable number is made, to limit the purchase. As such, in the game system according to the present example embodiment, an upper limit is set for the cumulative number of purchased "diamonds" to reliably prevent the user from spending a vast amount of money in item charging.

While "diamond" is employed as the item subject to item charging in the present example embodiment, this is a mere example and the item is not limited thereto. The item may also be virtual currency used in a game such as, for example, a gold coin or gold, or may not necessarily be virtual currency. The item may be, for example, a ticket or voucher that has some effect on a game. The item may be, for example, an accessory put on a character. The item may be, for example, a character to be operated by the user in a game. The item may also be, for example, any digital data or any numeric value or the like which increases or decreases during a game.

In the present example embodiment, the diamond purchasing screen illustrated in FIG. 1, the purchase number selecting screen illustrated in FIG. 4 and the confirmation screen illustrated in FIG. 5 are mere examples and the screens are not limited thereto. The sentences in a message shown in each screen, arrangement of buttons, screen configurations and the like are illustrated by way of examples, not by way of limitations. The associations between the number of diamonds and their prices illustrated in FIG. 4 are illustrated by way of examples, not by way of limitations. While the purchase number selecting screen illustrates a configuration in which a determined number of, e.g., fifty, one hundred . . . , one thousand "diamonds" may be purchased, the configuration is not limited thereto. It may also be configured such that an arbitrary number may be input by the user to purchase "diamond."

While the present example embodiment illustrates the configuration in which the number of "diamonds" purchasable by the user is displayed on the diamond purchasing screen, the configuration is not limited thereto. Another configuration may also be possible in which the purchasable number is not displayed on the diamond purchasing screen. In such a case, the processing such as inquiry to the server 3 and reception of a response performed at steps S2 and S3 in the flowchart of FIG. 6 may be eliminated. Another configuration may also be employed in which the number of "diamonds" purchasable by the user is displayed on another screen such as the purchase number selecting screen, for example.

While the present example embodiment is configured to lower the unit price for a "diamond" in accordance with the number of "diamonds" purchased at the same time, the configuration is not limited thereto. The unit price of a "diamond" may be fixed irrespective of the number of "diamonds" purchased at the same time. The association between the number of "diamonds" purchased at the same time and the price may vary. In such a case, the game device 1 may communicate with the server 3 to inquire the price before displaying the purchase number selecting screen and the server 3 may transmit to the game device 1 the association information between the price and the number of "diamonds" purchased at the same time as a response to the inquiry. While the present example embodiment has a configuration in which two awards are imparted to the user who purchased "diamonds" to the upper limit, the configuration is not limited thereto. Another configuration is possible in which either one of the awards is imparted or no award is imparted to the user who purchased "diamonds" to the upper limit.

While the present example embodiment illustrated a portable game device 1 as an example, the game device 1 is not limited thereto. For example, a similar technique may be applied to various information processing devices such as a stationary game device, a general-purpose computer, a tablet terminal device or a mobile phone. A part or all of the processing performed by the processing unit 10 of the game device 1 may be performed by another device such as the server 3 for example, and multiple devices may cooperate to implement the processing. Likewise, a part or all of the processing performed by the processing unit 30 of the server 3 may be performed by the game device 1 or another server, for example, and multiple devices may cooperate to implement the processing.

While a configuration is described in which the processing unit 10 of the game device 1 executes the game program 91 so that the game processing unit 21 to the display processing unit 23 are provided in the processing unit 10 as software functional blocks, the configuration is not limited thereto. A part of the functions of the game processing unit 21 to the display processing unit 23 may be offered as a function of an operating system (OS) for example, or may be offered as a hardware functional block. Likewise, while the processing unit 30 of the server 3 executes the server program 92*a* so that the item sales processing unit 41 is provided as a software functional block, the configuration is not limited thereto. A part of the functions of the item sales processing unit 41 may be offered as, for example, the function of OS, or as a hardware functional block.

Embodiment 2

The game system according to Embodiment 1 is so configured that the server 3 stores the cumulative number of "diamonds" purchased by the user under the user information 31*a* in the storage unit 31. On the other hand, the game system according to Embodiment 2 is configured to store the cumulative number of "diamonds" purchased by the user in each game device 1. The game device 1 according to Embodiment 2 stores the cumulative number of purchased "diamonds" related to the user who uses the game device 1 in the game data 11*a* in the storage unit 11. The game device 1 stores therein an upper limit value of the number of "diamonds" to be purchased as, for example, information associated with the game program 91*a*.

The game device 1 according to Embodiment 2 reads out the cumulative number of purchased "diamonds" from the game data 11*a* in the case where the column of "purchase diamond" is selected in the menu screen of a game, for example. The game device 1 calculates the number of "diamonds" purchasable by the user based on the cumulative number and the upper limit, and displays the diamond purchasing screen illustrated in FIG. 1 on the display unit 13. In the case where an operation for the "purchase" button is performed on the diamond purchasing screen, the game device 1 displays the purchase number selecting screen illustrated in FIG. 4 on the display unit 13. Here, the game device 1 according to Embodiment 2 does not display a selection column corresponding to the number of "diamonds" that cannot be purchased on the purchase number selecting screen, based on the number of "diamonds" purchasable by the user. Alternatively, the game device 1 displays a selection column for the number of "diamonds"

that cannot be purchased on the purchase number selecting screen but does not accept an operation of selecting this selection column. Using these methods, the game device 1 limits the purchase of "diamonds" that exceeded the upper limit for the user.

In the game system according to Embodiment 2, since a limitation on the purchase of "diamond" is set in the game device 1, no limitation needs to be set in the server 3. The server 3 according to Embodiment 2 may perform settlement processing in response to a purchase request sent from the game device 1 and impart "diamonds" corresponding to the requested number after the settlement processing is completed, without obtaining information related to the cumulative number of "diamonds" purchased by the user.

Imparting an award when the user purchases "diamonds" up to the upper limit may be performed by the game device 1. In such a case, the game device 1 may perform processing of imparting an award without the intermediary of the server 3. Alternatively, the game device 1 may request the server 3 to impart an award when the cumulative number of "diamonds" has reached the upper limit and the server 3 may impart the award in response to the request.

Figure 12:
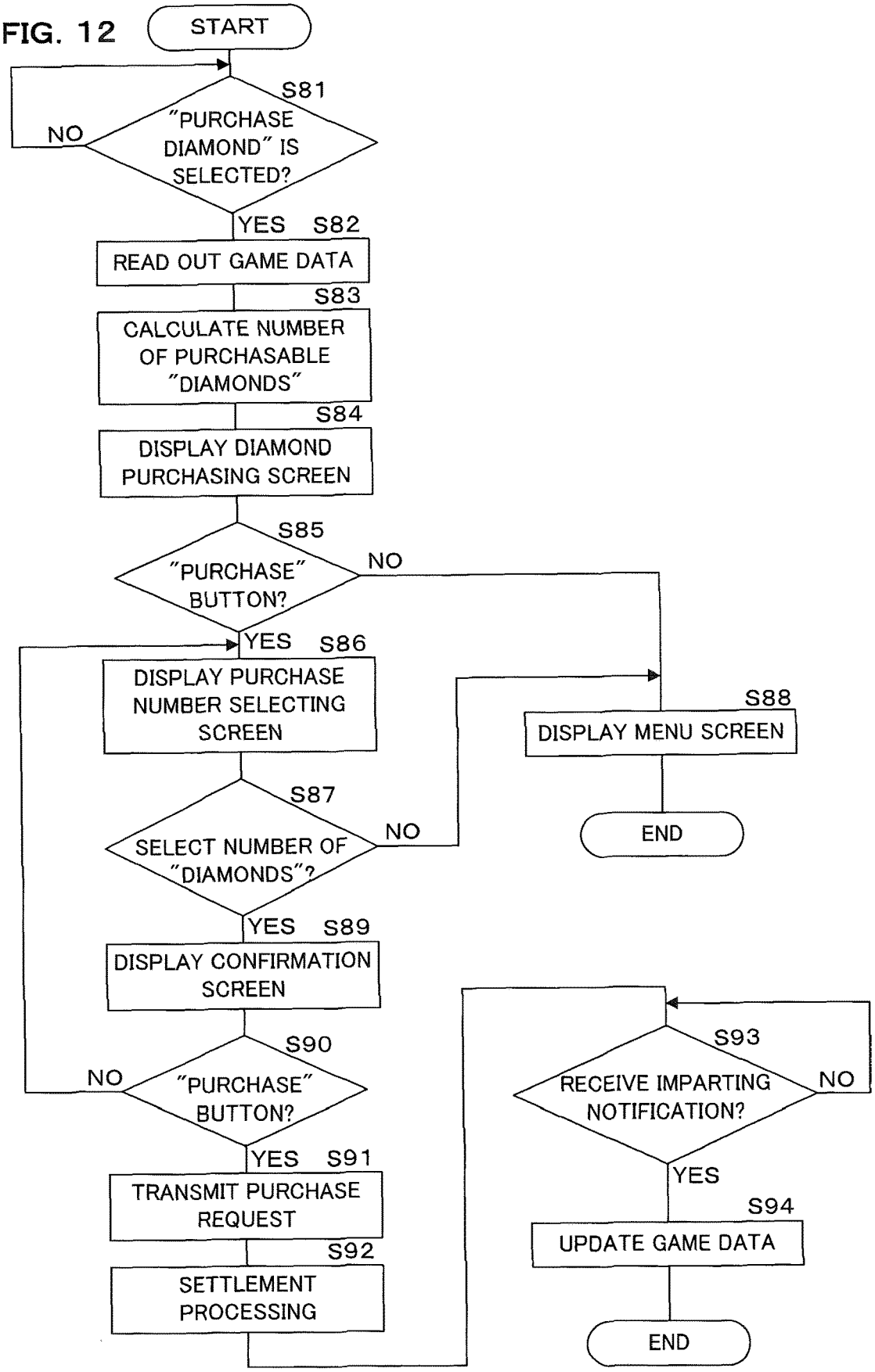
FIG. 12 shows an example non-limiting flowchart illustrating a procedure of "diamond" purchase processing performed by a game device according to Embodiment 2.

FIG. 12 shows an example non-limiting flowchart illustrating a procedure of "diamond" purchase processing performed by the game device 1 according to Embodiment 2. The item purchase processing unit 22 in the processing unit 10 of the game device 1 determines whether or not a column of "purchase diamond" is selected in the menu screen of a game (step S81). If the column of "purchase diamond" is not selected (S81: NO), the processing unit 10 waits until the column of "purchase diamond" is selected. If the column of "purchase diamond" is selected (S81: YES), the item purchase processing unit 22 reads out game data 11*a* stored in the storage unit 11 (step S82). The item purchase processing unit 22 obtains the cumulative number of "diamonds" purchased by the user from the game data 11*a* and compares the cumulative number with the set upper limit for "diamonds" to be purchased, to calculate the number of "diamonds" purchasable by the user (step S83). The display processing unit 23 in the processing unit 10 indicates the number of purchasable "diamonds" calculated by the item purchase processing unit 22, and displays the diamond purchasing screen illustrated in FIG. 1 on the display unit 13 (step S84).

In the state where the diamond purchasing screen is being displayed, the item purchase processing unit 22 in the processing unit 10 determines whether or not an operation for the "purchase" button is performed (step S85). If the operation for the "purchase" button is not performed (S85: NO), i.e. the operation for the cancel button is performed in the diamond purchasing screen, the display processing unit 23 in the processing unit 10 displays a menu screen on the display unit 13 (step S88), and terminates the processing. If the operation for the "purchase" button is performed (S85: YES), the display processing unit 23 displays the purchase number selecting screen illustrated in FIG. 4 on the display unit 13 (step S86). Here, the display processing unit 23 does not display a selection column for the number of "diamonds" that cannot be purchased by the user among multiple selection columns in the purchase number selecting screen.

In the state where the purchase number selecting screen is being displayed, the item purchase processing unit 22 in the processing unit 10 determines whether or not an operation of selecting the number of "diamonds" to be purchased is performed (step S87). If the operation of selecting the number of "diamonds" to be purchased is not performed (S87: NO), i.e. an operation for the cancel button is performed in the purchase number selecting screen, the display processing unit 23 in the processing unit 10 displays a menu screen on the display unit 13 (step S88), and terminates the processing. If an operation of selecting the number of "diamonds" to be purchased is performed (S87: YES), the display processing unit 23 displays a confirmation screen illustrated in FIG. 5 on the display unit 13 (step S89).

In the state where the confirmation screen is being displayed, the item purchase processing unit 22 in the processing unit 10 determines whether or not an operation for the "purchase" button is performed (step S90). If the operation for the "purchase" button is not performed (S90: NO), i.e. if an operation for the cancel button is performed in the confirmation screen, the processing unit 10 returns the processing to step S86 to display the purchase number selecting screen by the display processing unit 23. If the operation for the "purchase" button is performed (S90: YES), the item purchase processing unit 22 in the processing unit 10 communicates with the server 3 through the communication unit 15, and transmits a request for purchasing "diamond" with a designated number to be purchased to the server 3 (step S91). The item purchase processing unit 22 performs settlement processing with the server 3 (step S92). After terminating the settlement processing, the item purchase processing unit 22 determines whether or not a notification for imparting "diamond" is received from the server 3 (step S93). If the imparting notification is not received (S93: NO), the item purchase processing unit 22 waits until the imparting notification is received. If the imparting notification is received (S93: YES), the item purchase processing unit 22 updates game data 11*a* in the storage unit 11 so as to increase the number of "diamonds" possessed by the user based on the imparting notification (step S94), and terminates the processing.

Figure 13:
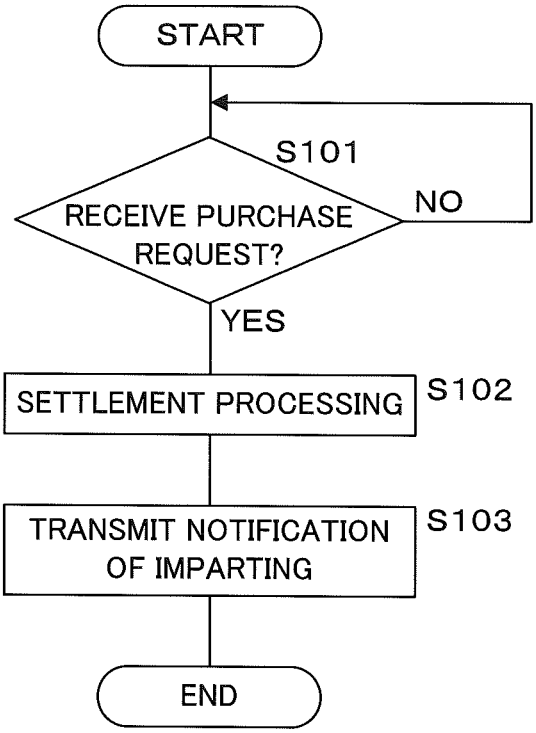
FIG. 13 shows an example non-limiting flowchart illustrating a procedure of "diamond" sales processing performed by a server according to Embodiment 2.

FIG. 13 shows an example non-limiting flowchart illustrating a procedure of "diamond" sales processing performed by the server 3 according to Embodiment 2. The item sales processing unit 41 in the processing unit 30 of the server 3 according to Embodiment 2 determines whether or not a purchase request for "diamond" is received from the game device 1 through the communication unit 33 (step S101). If the purchase request is not received (S101: NO), the item sales processing unit 41 waits until the purchase request from the game device 1 is received. If the purchase request is received from the game device (S101: YES), the item sales processing unit 41 performs settlement processing with the game device 1 (step S102). After terminating the settlement processing, the item sales processing unit 41 transmits a notification for imparting the number of "diamonds" requested to be purchased to the game device 1 through the communication unit 33 (step S103), and terminates the processing.

Figure 14:
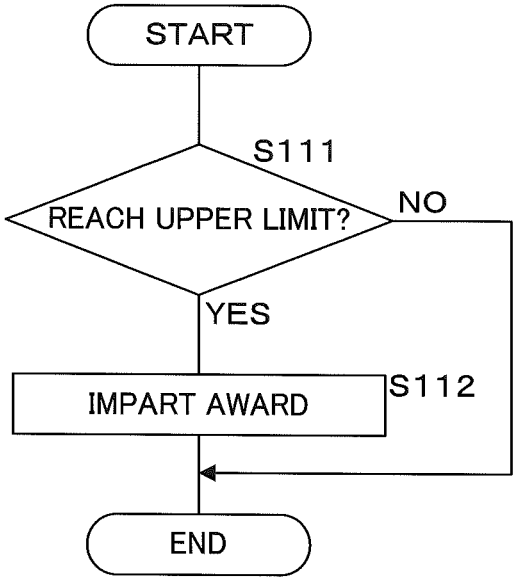
FIG. 14 shows an example non-limiting flowchart illustrating a procedure of award imparting processing performed by a game device according to Embodiment 2.

FIG. 14 shows an example non-limiting flowchart illustrating a procedure of award imparting processing performed by the game device 1 according to Embodiment 2. It is to be noted that the award imparting processing illustrated in the present flowchart is processing to be subsequently performed after the game data 11*a* is updated at step S94 in the "diamond" purchase processing illustrated in FIG. 12. The item purchase processing unit 22 of the game device 1 determines whether or not the cumulative number of purchased "diamonds" has reached the upper limit based on the updated game data 11*a* (step S111). If the cumulative number of purchased "diamonds" has not reached the upper limit (S111: NO), the item purchase processing unit 22 terminates the processing without imparting an award. If the cumulative number of purchased "diamonds" has reached the upper limit (S11: YES), the item purchase processing unit 22 imparts an award to the user (step S112), and terminates the processing.

In the game system according to Embodiment 2 with the configuration described above, the game device 1 stores the cumulative number of "diamonds" purchased by the user in the game data 11*a* in the storage unit 11 of the game device 1. The game device 1 limits the number of "diamonds" to be purchased by the user based on the stored cumulative number and the set upper limit. The game device 1 calculates the number of purchasable "diamonds" based on the cumulative number and the upper limit, and sets a limit to the purchase by not displaying a selection column for the number of "diamonds" that cannot be purchased on the purchase number selecting screen. Accordingly, the game system according to Embodiment 2 can provide an upper limit to the cumulative number of "diamonds" to be purchased to reliably prevent the user from spending a vast amount of money in item charging.

While such a configuration is employed in the present example embodiment that the game device 1 does not display a selection column for the number of "diamonds" that cannot be purchased on the purchase number selecting screen or no selection therefor is accepted even if such a selection column is displayed, the configuration is not limited thereto. The game device 1 may accept a selection for a selection column corresponding to the number exceeding the upper limit. In such a case, however, an error indication or the like may be displayed so as not to transmit a purchase request to the server 3.

According to the present technology herein, it can be expected to provide the user with the feeling of security in a game employing item charging.

It is noted that, as used herein and in the appended claims, the singular form "a," "an" and "the" include plural referents unless the context clearly dictates otherwise.

What is claimed is:

1. A game system, comprising:

a game device having processing circuitry including, a memory, a processor configured to perform information processing related to a game and a communication device configured to communicate via a network; and a server having processing circuitry including, a memory, a processor, and a communication device configured to perform communication with the game device via the network, wherein the processing circuitry of the game device is further configured to transmit a purchase request for a first item to be used in the game to the server by communication through the communication device, the processing circuitry of the server further configured to:

receive the purchase request for the first item transmitted by the game device;

access the memory of the server to determine a cumulative number of first items purchased by a user who plays the game with the game device;

determine if the purchase request for the first item exceeds an upper limit set for the cumulative number of first items to be purchased for the user in order to increase security of the user purchasing the first item; and impart the first item in response to the received purchase request based on the determination of whether the purchase request for the first item exceeds the upper limit set for the cumulative number of first items, and the processing circuitry of the game device is further configured to:

receive the first item imparted from the server and store the first item in the memory of the game device; and update game data in the game using the first item stored in the memory of the game device, wherein the processing circuitry of the server is further configured to impart a second item to be used in the game to the user in a case where the cumulative number of the purchased first item reaches the upper limit, the first item is imparted in a case where the second item is used in the game, and the game device includes a display processing device configured to perform processing of displaying a purchasable number of the first items in accordance with the upper limit.

2. The game system according to claim 1, wherein the processing circuitry of the server further configured to impart a predetermined right concerning the game to the user in the case where the cumulative number of the purchased first items reaches the upper limit.

3. The game system according to claim 2, wherein the imparted predetermined right is a right making a play in the game comfortable.

4. The game system according to claim 2, wherein the imparted predetermined right is a right to obtain the first item without purchasing.

5. The game system according to claim 4, wherein the imparted predetermined right is a right to continuously obtain the first item without purchasing.

6. The game system according to claim 4, wherein the imparted predetermined right is a right to obtain the first item by satisfying a predetermined condition in the game without purchasing.

7. The game system according to claim 2, wherein the first item is virtual currency usable in the game, and the imparted predetermined right is a right to reduce a consumption amount of the virtual currency in a case of using the virtual currency in the game.

8. The game system according to claim 1, wherein the second item is an item not reduced in a number of possessions even if used in the game.

9. The game system according to claim 1, wherein the display processing device is configured to display the imparted second item on a display device; and the processing circuitry of the game device further configured to accept an operation using the second item displayed by the display processing device, and impart the first item in a case where the operation using the second item is accepted.

10. The game system according to claim 1, wherein the processing circuitry of the server is further configured to reduce a unit price as the number of the first items purchased at the same time is increased.

11. The game system according to claim 1, wherein the first item is an item that can be obtained in the game without purchasing.

12. The game system according to claim 1, wherein the first item is an item reduced in a number of possessions by using the item in the game.

13. The game system according to claim 1, wherein the processing circuitry of the server further configured to limit a purchase of the first item in accordance with the cumulative number stored in the memory and the upper limit.

14. The game system according to claim 1, wherein the game device includes a storage device configured to store the cumulative number of the purchased first items, and the processing circuitry of the game device further configured to limit the purchase of the first item in accordance with the cumulative number stored in the storage device and the upper limit.

15. A game device, comprising processing circuitry including a processor configured to perform information processing related to a game, a storage device, and a communication device configured to communicate with a server via a network, the processing circuitry of the game device configured to:

transmit a purchase request for a first item to be used in the game to the server by 1communication through the communication device;

receive the first item from the server using the communication device;

store a cumulative number of the first items purchased in the storage device;

access the storage device to determine the cumulative number of the first items purchased;

limit the number of the first items to be purchased to a predetermined upper limit in accordance with the cumulative number accessed from the storage device in order to increase security of a user purchasing the first item; and update game data in the game using the first item received from the server, wherein a second item to be used in the game is imparted to the user in a case where the cumulative number of the purchased first item reaches the upper limit, the first item is imparted in a case where the second item is used in the game, and the game device includes a display processing device configured to perform processing of displaying a purchasable number of the first items in accordance with the upper limit.

16. A server, comprising a storage device and processing circuitry including a communication device configured to perform communication with a game device via a network, the processing circuitry of the server configured to:

receive a purchase request for a first item to be used in a game transmitted by the game device by communicating with the game device through the communication device;

access the storage device of the server to determine a cumulative number of first items purchased by a user who plays the game with the game device;

determine if the purchase request for the first item exceeds an upper limit set for the cumulative number of first items to be purchased in order to increase security of the user purchasing the first item;

impart the first item in response to the received purchase request based on the determination of whether the purchase request for the first item exceeds the upper limit set for the cumulative number of first items;

store the cumulative number of the purchased first items in the storage device; and limit the number of the first items to be purchased to the upper limit in accordance with the cumulative number stored in the storage device, wherein the game device receives the first item and stores the first item in a memory of the game device, and the game device updates game data in the game using the first item stored in the memory of the game device, a second item to be used in the game is imparted to the user in a case where the cumulative number of the purchased first item reaches the upper limit, the first item is imparted in a case where the second item is used in the game, and the second item is imparted during a first time period and is then made unavailable until a second time period.

17. A non-transitory recording medium in which an information processing program is recorded, the information processing program causing a game device comprising processing circuitry including at least a memory and a processor configured to perform information processing related to a game and a communication device configured to communicate with a server via a network to:

transmit a purchase request for the first item to be used in the game to the server by communication through the communication device;

receive the first item from the server using the communication device;

store a cumulative number of the first items to be purchased in a storage device;

access the storage device to determine the cumulative number of first items purchased;

limit the purchase of the first item to a predetermined upper limit in accordance with the cumulative number accessed from the storage device in order to increase security of a user purchasing the first item; and update game data in the game using the first item received from the server, wherein a second item to be used in the game is imparted to the user in a case where the cumulative number of the purchased first item reaches the upper limit, the first item is imparted in a case where the second item is used in the game, and the game device includes a display processing device configured to perform processing of displaying a purchasable number of the first items in accordance with the upper limit.

18. A non-transitory recording medium in which an information processing program is recorded, the information processing program causing a server comprising processing circuitry including a communication device configured to communicate with a game device via a network to:

receive a purchase request for a first item to be used in a game transmitted by the game device by communicating with the game device through the communication device;

access a memory of the server to determine a cumulative number of first items purchased by a user who plays the game with the game device;

determine if the purchase request for the first item exceeds an upper limit set for the cumulative number of first items to be purchased in order to increase security of the user purchasing the first item;

impart the first item in response to the received purchase request based on the determination of whether the purchase request for the first item exceeds the upper limit set for the cumulative number of first items;

store the cumulative number of the purchased first items in the memory; and limit the number of the first items to be purchased to the upper limit in accordance with the cumulative number stored in the memory, wherein the game device receives the first item and stores the first item in a memory of the game device, and the game device updates game data in the game using the first item stored in the memory of the game device, a second item to be used in the game is imparted to the user in a case where the cumulative number of the purchased first item reaches the upper limit, the first item is imparted in a case where the second item is used in the game, and the second item is imparted during a first time period and is then made unavailable until a second time period.

19. An item purchase limitation method, comprising transmitting, by a game device including processing circuitry having at least a processor configured to perform information processing related to a game and a communication device configured to perform communication via a network, a purchase request for a first item to be used in the game to a server by communication through the communication device;

receiving, by the server, the transmitted purchase request;

accessing, by the server, a memory of the server to determine a cumulative number of first items purchased by a user who plays the game with the game device determining, by the server, if the purchase request for the first item exceeds an upper limit set for the cumulative number of first items to be purchased in order to increase security of the user purchasing the first item;

imparting, by the server, the first item in response to the received purchase request based on the determination of whether the purchase request for the first item exceeds the upper limit set for the cumulative number of first items;

receiving, by the game device, the first item imparted from the server and storing the first item in the memory of the game device; and updating, by the game device, game data in the game using the first item stored in the memory of the game device, wherein a second item to be used in the game is imparted to the user in a case where the cumulative number of the purchased first item reaches the upper limit, the first item is imparted in a case where the second item is used in the game, and the game device includes a display processing device configured to perform processing of displaying a purchasable number of the first items in accordance with the upper limit.

20. A game system, comprising a game device having processing circuitry including a memory and a processor configured to perform information processing related to a game and a communication device configured to communicate via a network, and a server having processing circuitry including a communication device configured to perform communication with the game device via the network, wherein the processing circuitry of the game device is further configured to:

access the memory of the game device to determine a cumulative number of first items purchased by a user who plays the game with the game device;

determine if a purchase request for a first item to be used in the game exceeds an upper limit set for the cumulative number of first items to be purchased for the user in order to increase security of the user purchasing the first item; and transmit the purchase request for the first item to the server by communication through the communication device based on the determination of whether the purchase request for the first item exceeds the upper limit set for the cumulative number of first items, the processing circuitry of the server further configured to:

receive the purchase request for the first item transmitted by the game device; and impart the first item in response to the received purchase request, and the processing circuitry of the game device is further configured to:

receive the first item imparted from the server and store the first item in the memory of the game device; and update game data in the game using the first item stored in the memory of the game device, wherein the processing circuitry of the server is further configured to impart a second item to be used in the game to the user in a case where the cumulative number of the purchased first item reaches the upper limit, the first item is imparted in a case where the second item is used in the game, and the game device includes a display processing device configured to perform processing of displaying a purchasable number of the first items in accordance with the upper limit.

21. The game system according to claim 1, wherein the first item is used to purchase an accessory for a game character in the game.

22. The game system according to claim 1, wherein the first item is used to purchase an additional scenario of the game.

23. The game system according to claim 1, wherein the second item is imparted during a specified interval of time.

24. The game system according to claim 1, wherein the first item is a virtual currency and the second item is an award granting a right to receiving an amount of the virtual currency.

25. The game system according to claim 24, wherein the award is imparted during a specified interval of time and the award cannot be imparted again until the specified interval of time has elapsed.

26. A game system, comprising:

a game device having processing circuitry including, a memory, a processor configured to perform information processing related to a game and a communication device configured to communicate via a network; and a server having processing circuitry including, a memory, a processor, and a communication device configured to perform communication with the game device via the network, wherein the processing circuitry of the game device is further configured to transmit a purchase request for a first item to be used in the game to the server by communication through the communication device, the processing circuitry of the server further configured to:

receive the purchase request for the first item transmitted by the game device;

access the memory of the server to determine a cumulative number of first items purchased by a user who plays the game with the game device;

determine if the purchase request for the first item exceeds an upper limit set for the cumulative number of first items to be purchased for the user in order to increase security of the user purchasing the first item; and impart the first item in response to the received purchase request based on the determination of whether the purchase request for the first item exceeds the upper limit set for the cumulative number of first items, and the processing circuitry of the game device is further configured to:

receive the first item imparted from the server and store the first item in the memory of the game device; and update game data in the game using the first item stored in the memory of the game device, wherein the processing circuitry of the server is further configured to impart a second item to be used in the game to the user in a case where the cumulative number of the purchased first item reaches the upper limit, the first item is imparted in a case where the second item is used in the game, and the second item is imparted during a first time period and is then made unavailable until a second time period.

* * * * *